US006824426B1

(12) United States Patent
Spink, Jr.

(10) Patent No.: US 6,824,426 B1
(45) Date of Patent: Nov. 30, 2004

(54) HIGH SPEED ELECTRICAL CABLE ASSEMBLY

(75) Inventor: William E. Spink, Jr., Laguna Niguel, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/776,077

(22) Filed: Feb. 10, 2004

(51) Int. Cl.[7] ..... H01R 9/05
(52) U.S. Cl. ..... 439/579
(58) Field of Search ..... 439/579, 353, 439/357, 108, 499, 610, 637, 634, 567, 92

(56) References Cited

U.S. PATENT DOCUMENTS 5,953,815 A * 9/1999 Kaminski et al. ..... 29/860
6,074,251 A * 6/2000 Edgerly et al. ..... 439/610
6,210,230 B1 * 4/2001 Lai ..... 439/610
6,217,374 B1 * 4/2001 O'Sullivan ..... 439/499
6,305,978 B1 * 10/2001 Ko et al. ..... 439/579
6,331,122 B1 12/2001 Wu
D469,407 S 1/2003 Wu
6,544,050 B1 * 4/2003 Ko ..... 439/108
6,592,401 B1 7/2003 Gardner et al.
6,648,676 B1 * 11/2003 Lee ..... 439/499
6,648,682 B1 * 11/2003 Wu ..... 439/567
6,659,791 B1 * 12/2003 Ko et al. ..... 439/353
6,672,905 B2 * 1/2004 Tharp et al. ..... 439/660
6,685,495 B1 * 2/2004 Ko ..... 439/353
6,743,053 B2 * 6/2004 Wu ..... 439/634
6,746,281 B1 * 6/2004 Zhang ..... 439/637

* cited by examiner

*Primary Examiner*—Ross Gushi
*Assistant Examiner*—Phuongchi Nguyen
(74) *Attorney, Agent, or Firm*—Wei Te Chung

(57) ABSTRACT

An electrical cable assembly (100) includes a unitary longitudinal insulative housing (1) having a base (10) and a mating section (12) extending forwardly from the base. The mating section defines an uninterrupted central slot (123) along a lengthwise direction thereof and includes opposite first and second elongated walls (120, 121) located at two longitudinal sides of the central slot. The first wall defines a cavity (124) recessed from an interior face thereof and in communication with the central slot in a transverse direction. The second wall is integrally formed with an expanded portion (125) on an exterior face thereof and in alignment with the cavity in the transverse direction. A number of contacts (2) are received in the housing and electrically connect with corresponding wires (3). A cover (5) is overmolded on the base to cover the contacts and the wires.

12 Claims, 10 Drawing Sheets

HIGH SPEED ELECTRICAL CABLE ASSEMBLY

CROSS-REFERENCE TO RELATED APPLICATIONS

Relevant subject matter is disclosed in U.S. patent application Ser. Nos. 10/456,369 filed on Jun. 6, 2003 and entitled "HIGH SPEED ELECTRICAL CONNECTOR" and 10/678,991 filed on Oct. 2, 2003 and entitled "HIGH SPEED ELECTRICAL CONNECTOR", both of which are assigned to the same assignee as this application.

BACKGROUND OF THE INVENTION

1. Field of the Invention

The present invention relates to an electrical cable assembly, and particularly to a high speed Serial Attached SCSI (Small Computer System Interface) (SAS) cable assembly.

2. Description of Related Art

Parallel ATA (Advanced Technology Attachment) and parallel SCSI are two dominant disk interface technologies today. The parallel ATA disks are widely used in desktop PCs and mobile PCs, and the parallel SCSI disks are mainly used in high-volume servers and subsystems. As disk interconnect speeds continue to rise, existing parallel ATA and parallel SCSI buses are reaching their performance limits because that parallel transmissions are susceptible to crosstalk across multiple streams of wide ribbon cable that adds line noise and can cause signal errors-a pitfall that has been remedied by slowing the signal, limiting cable length or both. Therefore, new interconnect technologies are needed to meet performance requirements going forward. The serial technology is emerging as a solution to the problem. The main advantage of serial technology is that while it does move data in a single point-to-point stream, it does so much faster than parallel technology because it is not tired to a particular clock speed.

Serial ATA (SATA) is a serial version of ATA, which is expected to be a replacement for parallel ATA. U.S. Pat. No. 6,648,676 discloses a panel mount SATA cable assembly. The cable assembly includes a cable end receptacle connector and a cable terminated to the receptacle connector. The receptacle connector includes an insulative housing defining two receiving slots separated by a partition therebetween and two sets of contacts respectively installed in the two slots for signal and power transmission. U.S. Pat. No. 6,331,122 discloses a type of SATA receptacle connector for being mounted on a printed circuit board. U.S. Pat. No. D469407 discloses an electrical connector assembly with a SATA plug connector as a part thereof for matably engaging with the SATA cable assembly or the SATA receptacle connector.

Serial Attached SCSI is a successor to the parallel SCSI and is also based on serial technology. Besides the advantage of higher speed signal transmission, another most significant advantage is the SAS interface will also be compatible with SATA drives. In other words, the SATA plug connector can plug directly into a SAS receptacle connector if supported in the system. By this way, the system builders are flexible to integrate either SAS or SATA devices and slash the costs associated with supporting two separate interfaces.

The SAS receptacle connector has generally the same configuration as the SATA receptacle connector except that the two slots of the SATA receptacle connector are merged in a large one of SAS receptacle connector. In some applications, a third sets of contacts are assembled to a second side wall opposing a first side wall where two sets of contacts have already been assembled. However, the second side wall is much thinner than the first side wall in a lateral direction of the connector. Thus, it is difficult to provide passages in such second side wall like in the first side wall for receiving contacts and allowing the contact portion of each contact to be moveable therein. If the third sets of contacts are directly adhered on an interior face of the second side wall with each contact portion curved away from the interior face, when a SAS plug connector mates with the SAS receptacle connector, terminals of the SAS plug connector tightly abut against the corresponding contacts of the SAS receptacle connector to establish an electrical connection therebetween. However, the contact portion of each contact is inevitably deformed toward the interior face after a long term pressure of the terminal, which will reduce the normal contacting force between the contact and the terminal, thereby causing the electrical connection therebetween unreliable or even break.

The present invention aims to provide a cable assembly having an improved cable end connector to overcome the disadvantages of the related art.

SUMMARY OF THE INVENTION

Accordingly, it is an object of the present invention to provide a cable assembly having a cable end connector which can provide a reliable electrical connection with a complementary connector.

It is another object of the present invention to provide a cable assembly having a cable end connector which is adapted to mate with a SATA header connector and a SAS header connector.

In order to achieve the objects set forth, a cable assembly in accordance with the present invention comprises a unitary longitudinal insulative housing comprising a base and a mating section extending forwardly from the base. The mating section defines an uninterrupted central slot along a lengthwise direction thereof. The mating section comprises opposite first and second elongated walls located at two longitudinal sides of the central slot. The first wall defines a cavity recessed from an interior face thereof and in communication with the central slot in a transverse direction. A plurality of first and second contacts are disposed in the first elongated wall along the longitudinal direction and separated by the cavity. A plurality of wires electrically connects with corresponding first and second contacts. A cover is over-molded on the base to cover the contacts and the wires.

According to one aspect of the present invention, the second wall is integrally formed with an expanded portion on an exterior face of the second wall and in alignment with the cavity in the transverse direction. A plurality of third contacts is disposed in the expanded portion and electrically connects with a plurality of wires.

Other objects, advantages and novel features of the invention will become more apparent from the following detailed description when taken in conjunction with the accompanying drawings.

DETAILED DESCRIPTION OF THE PREFERRED EMBODIMENT

Figure 1:
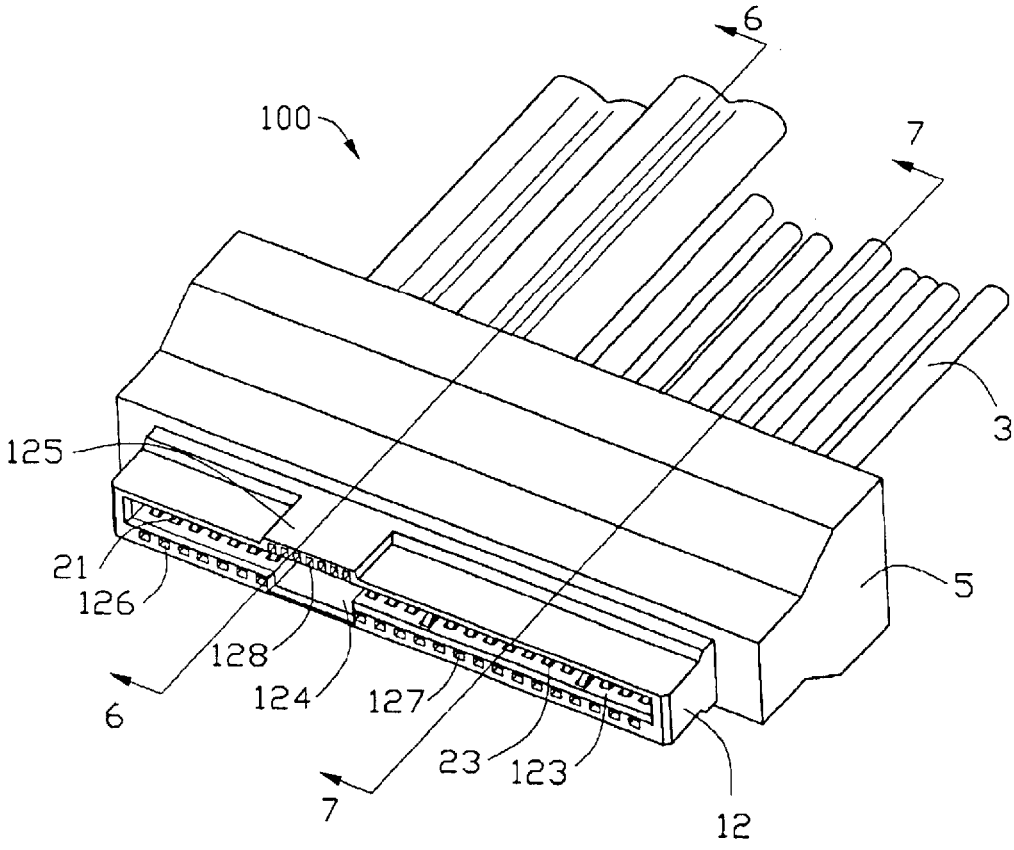
FIG. 1 is a perspective view of a cable assembly in accordance with a first embodiment of the present invention.

Reference will now be made in detail to the preferred embodiment of the present invention.

Referring to FIGS. 1–4, an electrical cable assembly 100 in accordance with the present invention comprises an insulative housing 1, a plurality of contacts 2 received in the housing 1, a plurality of wires 3 electrically connecting with the contacts 2, a spacer 4 attached to the housing 1 and a cover 5 over-molded with the housing 1.

The housing 1 includes an elongated base 10 and a mating section 12 extending forwardly from the base 10. The mating section 12 has opposite first and second elongated side walls 120, 121 and a pair of opposite lateral end walls 122 connecting with the first and the second side walls 120, 121, together defining an uninterrupted central slot 123 along a lengthwise direction of the housing 1. The first side wall 120 defines a cavity 124 recessed from an interior face thereof and in communication with the central slot 123 in a transverse direction. The second side wall 121 is integrally formed with an expanded portion 125 on an exterior face thereof and in alignment with the cavity 124 in the transverse direction. The cavity 124 divides the first side wall 120 into two portions having different dimensions along the longitudinal direction. The thickness of the first side wall 120 is larger than that of the second side wall 121.

The housing 1 defines plural first and second passageways 126, 127 in the first side wall 120 and plural third passageways 128 in the expanded portion 125 of the second side wall 121. The first, the second and the third passageways 126, 127, 128 extend through the housing 1 along a front-to-back direction.

Figure 5:
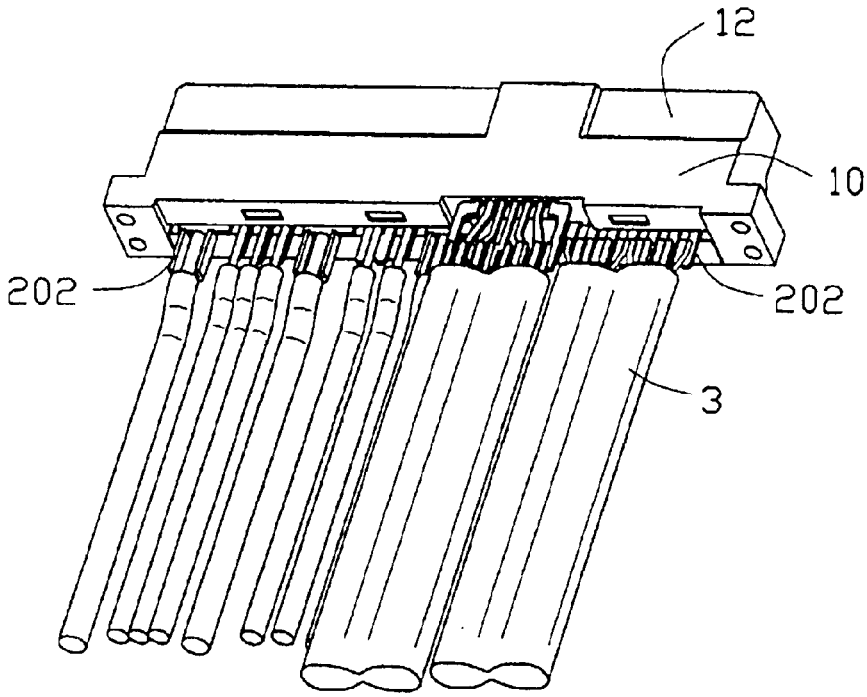
FIG. 5 is a perspective view of the cable assembly without showing an over-molded cover thereof.
Figure 6:
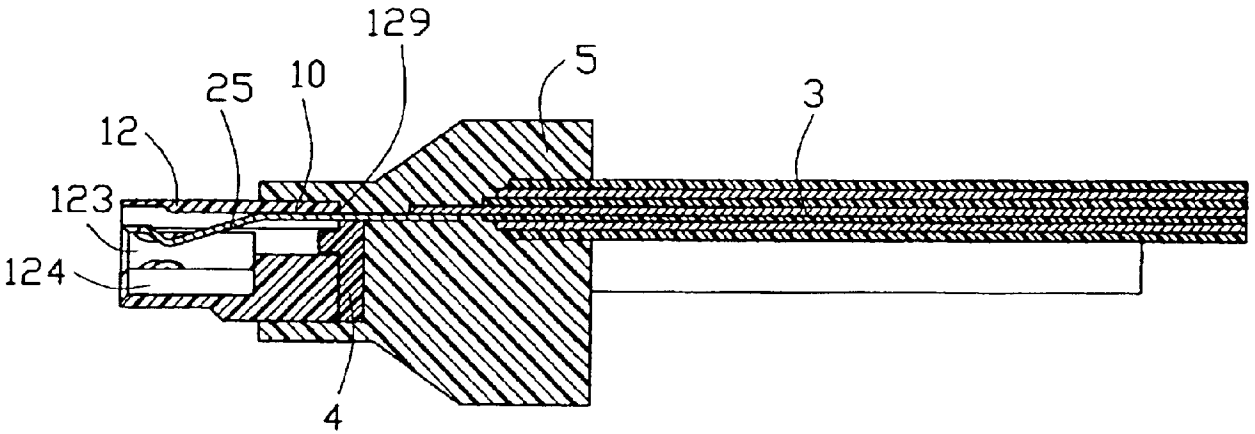
FIG. 6 is a cross-section view taken along line 6—6 of FIG. 1.
Figure 7:
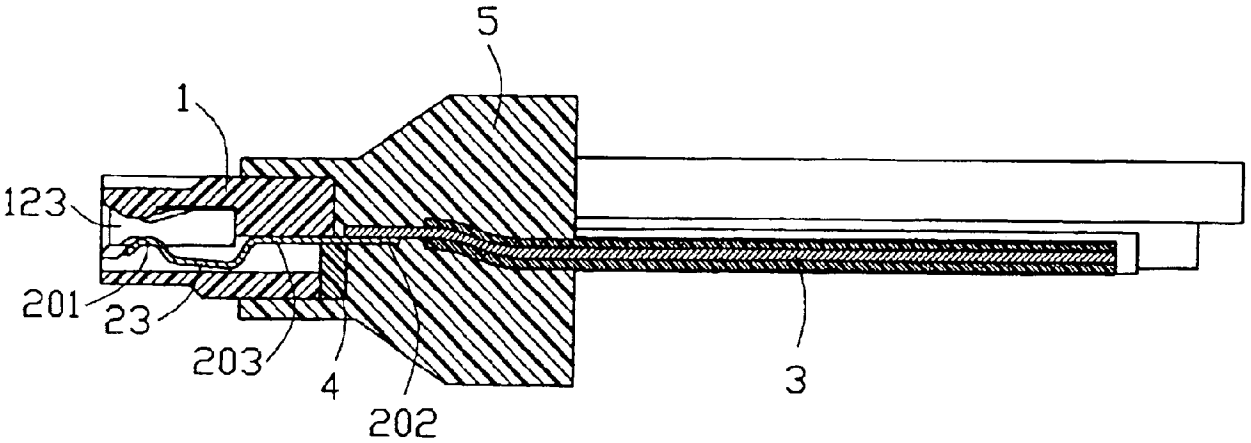
FIG. 7 is a cross-section view taken along line 7—7 of FIG. 1.

The contacts 2 comprise plural first, second and third contacts 21, 23, 25 respectively received in the first, the second and the third passageways 126, 127, 128 of the housing 1. Each contact 2 includes a contact portion 200 with a curved contact section 201 exposed in the central slot 123 of the housing 1, a tail portion 202 rearwardly extending out of the housing 1, and a retention portion 203 connecting the contact portion 200 and the tail portion 202. The retention portion 203 has an interferential engagement with the housing 1 to retain the contact 2 in the housing 1. The tail portions 202 of the first and the second contacts 21, 23 are arranged in a first row, and the tail portions 202 of the third contacts 25 are arranged in a second row offsetting from the first row in the transverse direction Referring to FIGS. 5–7 in conjunction with FIGS. 3–4, the first and the third contacts 21, 25 are soldered with corresponding wires 3 and respectively comprise two pairs of differential signal contacts and three ground contacts arranged at opposite sides of each pair of the differential signal contacts. The second contacts 23 comprise three sets of power contacts 230 and two sets of ground contacts 232 arranged between adjacent two sets of power contacts 230. Each set of power contacts 230 comprises three power contacts having a common tail portion 202 soldered to a corresponding wire 3 and three contact portions 200 each having a curved contact section 201 exposed in the central slot 123 of the housing 1. One set of ground contacts 232 is soldered with corresponding wires 3 in a one-to-one relationship, and the other set of ground contacts 232 comprises three ground contacts two of which are soldered to a common wire 3 and another one is soldered to a corresponding wire 3.

The spacer 4 is made of plastic material and is mounted on a rear face of the housing 1 to seal the rear face except for a plurality of slits 129 (FIG. 6) through which the tail portions 202 of the contacts 2 extend rearwardly.

Figure 2:
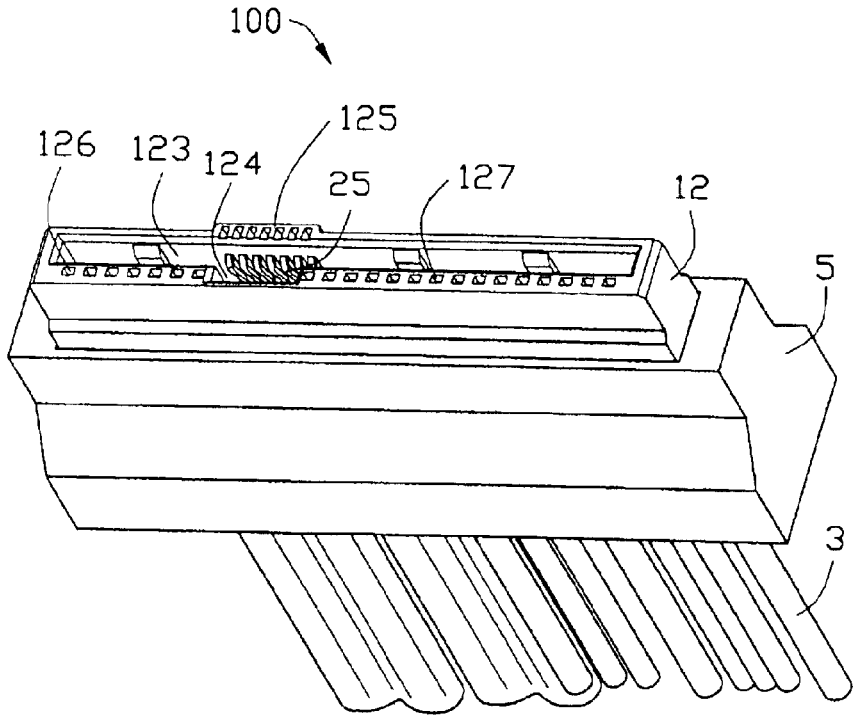
FIG. 2 is a view similar to FIG. 1 but taken from a different aspect.
Figure 3:
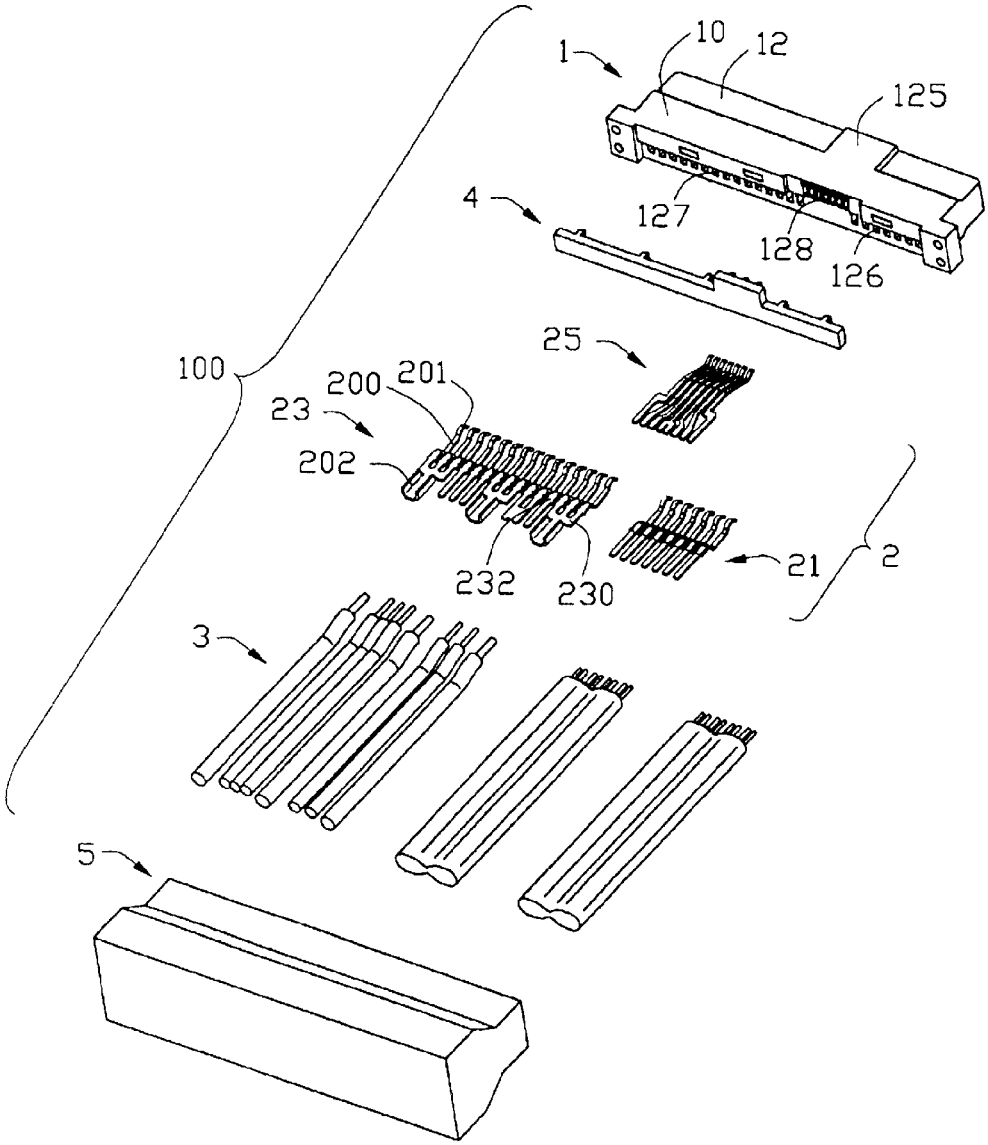
FIG. 3 is an exploded perspective view of the cable assembly of FIG. 1.
Figure 4:
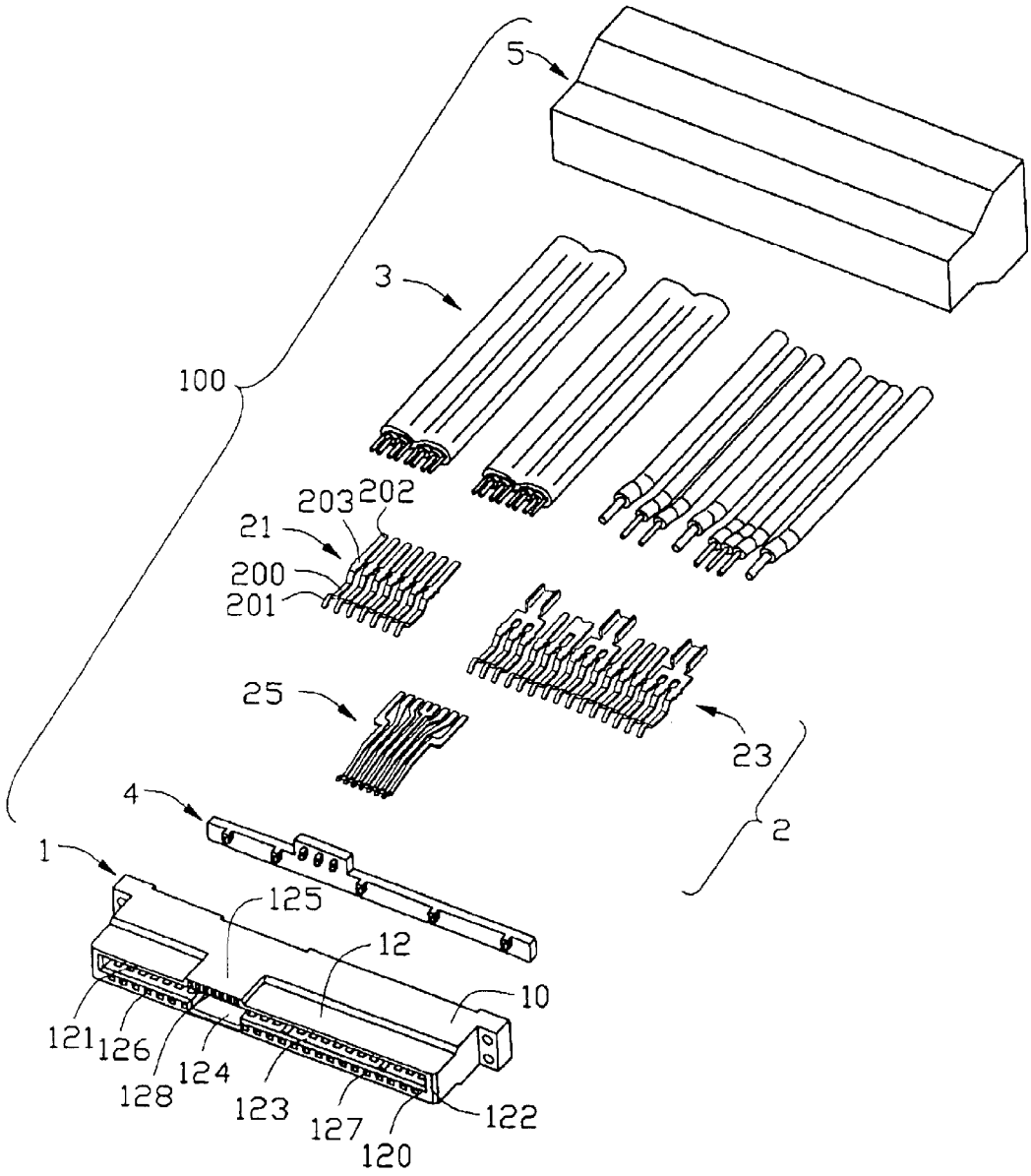
FIG. 4 is a view similar to FIG. 3 but taken from a different aspect.

The cover 5 is over-molded on the base 10 of the housing 1 to cover the contacts 2 and the wires 3. The electrical cable assembly 100 is thus formed as best shown in FIGS. 1 and 2.

Figure 8:
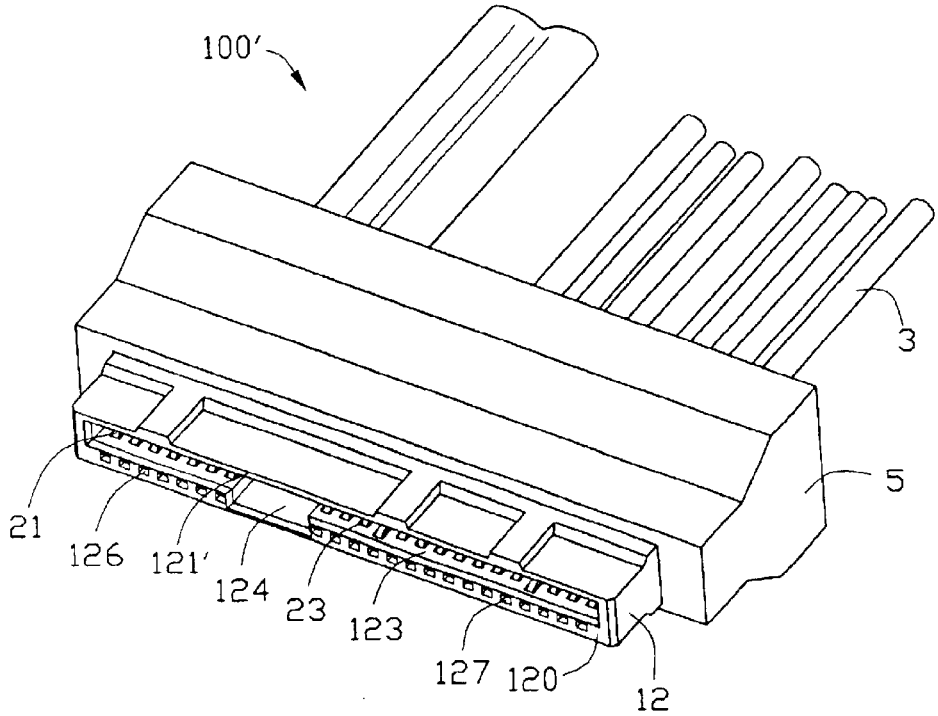
FIG. 8 is a perspective view of a cable assembly in accordance with a second embodiment of the present invention.
Figure 9:
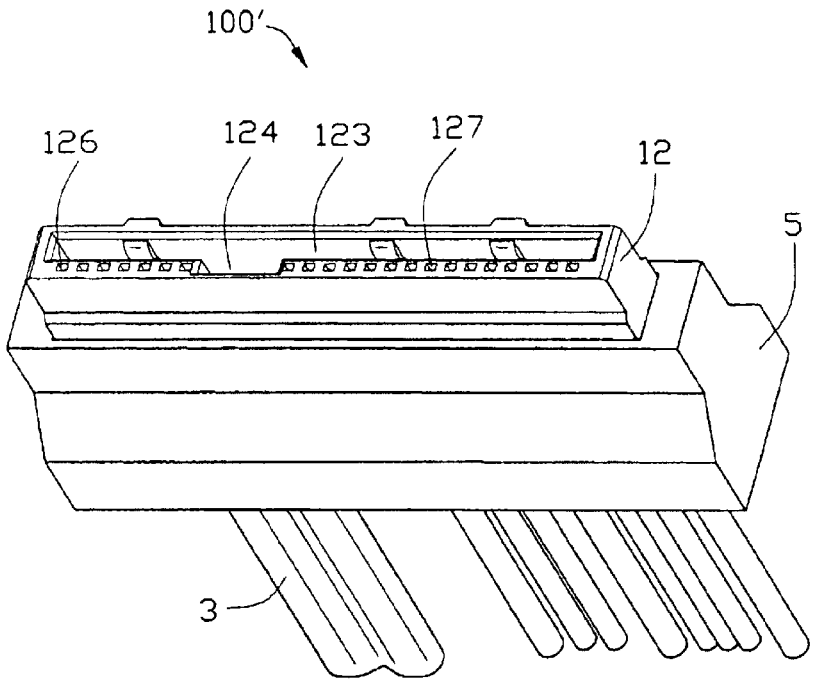
FIG. 9 is a view similar to FIG. 8 but taken from a different aspect.
Figure 10:
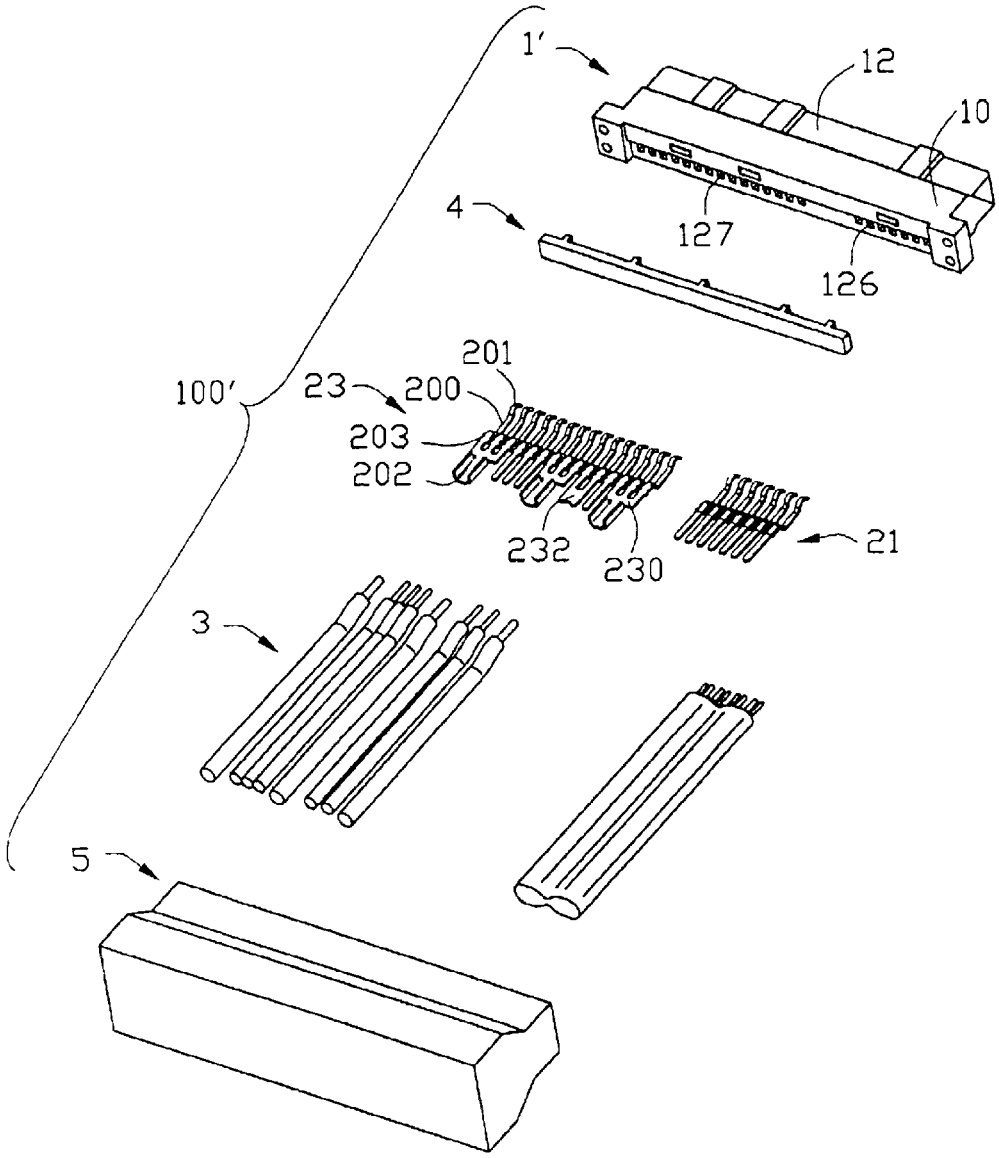
FIG. 10 is an exploded perspective view of the cable assembly of FIG. 8.

Referring to FIGS. 8–10, an electrical cable assembly 100' in accordance with a second embodiment of the present invention has a structure substantially the same as that of the electrical cable assembly 100 except that a second side wall 121' of an insulating housing 1' has no expanded portion formed on an exterior face thereof and in alignment with the cavity 124 in the transverse direction. Accordingly, the second contacts 23 and the corresponding wires 3 electrically connecting with the second contacts 23 of the electrical cable assembly 100 do not exist in the cable assembly 100'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical cable assembly comprising:

a unitary longitudinal insulative housing defining an uninterrupted central slot along a lengthwise direction thereof, the housing comprising opposite first and second elongated walls located at two longitudinal sides of the central slot;

a cavity recessed from an interior face of the first elongated wall and in communication with the central slot in a transverse direction;

a plurality of first and second contacts disposed in the first elongated wall and separated by the cavity; and a plurality of wires electrically connecting with the first and the second contacts;

wherein a plurality of third contacts disposed in the second elongated wall and in alignment with the cavity in the transverse direction, and further comprising a plurality of wires electrically connecting with the third contacts;

wherein the second elongated wall is thinned except for a portion receiving the third contacts;

wherein the second elongated wall has an expanded portion integrally formed on an exterior face thereof and in alignment with the cavity in the transverse direction;

wherein a plurality of third contacts and a plurality of wires electrically connecting with the third contacts, and wherein the expanded portion defines a plurality of passageways receiving the corresponding third contacts;

wherein a spacer mounted on a rear face of the housing to seal the rear face except for a plurality of slits through which the first, the second and the third contacts extend rearwardly;

wherein each contact comprises a contact portion with a curved contact section exposed in the central slot of the housing, a tail portion extending outwardly from the housing, and a retention portion connecting the contact portion and the tail portion;

wherein a cover over-molded on the housing to cover the first, the second and the third contacts and the wires;

wherein the tail portions of the first and the second contacts are arranged in a first row, and wherein the tail portions of the third contacts are arranged in a second row offsetting from the first row in the transverse direction.

2. The electrical cable assembly as claimed in claim 1, wherein the thickness of the first elongated wall is larger than that of the second elongated wall.

3. The electrical cable assembly as claimed in claim 1, wherein the cavity divides the first elongated wall into two portions having different dimensions along the longitudinal direction.

4. The electrical cable assembly as claimed in claim 1, wherein the second contacts comprise three sets of power contacts and two sets of ground contacts arranged between adjacent two sets of power contacts.

5. The electrical cable assembly as claimed in claim 4, wherein each set of power contacts comprises three power contacts having a common tail portion soldered to a corresponding wire and three contact portions each having a curved contact section exposed in the central slot of the housing.

6. The electrical cable assembly as claimed in claim 5, wherein one set of ground contacts is soldered with corresponding wires in a one-to-one relationship, and wherein the other set of ground contacts comprises three ground contacts two of which are soldered to a common wire and another one is soldered to a corresponding wire.

7. The electrical cable assembly as claimed in claim 1, wherein the insulative housing comprises a base and a mating section extending forwardly from the base, the first and the second elongated walls being formed on the mating section.

8. The electrical cable assembly as claimed in claim 7, further comprising a cover over-molded on the base to cover the first and the second contacts and the wires.

9. The electrical cable assembly as claimed in claim 7, further comprising a spacer mounted on a rear face of the housing to seal the rear face except for a plurality of slits through which the first and the second contacts extend rearwardly.

10. An electrical cable connector assembly comprising:

an insulative housing defining therein a elongated slot extending, along a longitudinal direction, with opposite first and second wall by two sides thereof;

a plurality of first passageways defined in the first wall;

a plurality of first contacts disposed in the corresponding first passageways, respectively;

the second wall defining a plurality of second passageways therein;

a plurality of second contacts disposed in the corresponding second passageways, respectively;

an amount of said first contacts being equal to that of the second contacts while said second contacts being more densely arranged in said longitudinal direction than said first contacts;

first and second identical sets of cables respectively connected to said first and second contacts, the first set including a plurality of first conductors respectively connected to rear ends of the first contacts, the second set including a plurality of second conductors respectively connected to rear ends of the second contacts, and a pitch of said first and second conductors of said first and second identical sets of cables being larger than that of the second contacts but smaller than that of the first contacts; wherein the rear ends of the second contacts are laterally and outwardly offset to comply with the pitch of the second set of cable so as to allow the second conductors to be directly aligned with the corresponding second contacts in a front-to-back direction for soldering;

the rear ends of the first contacts are kept straight as other portions thereof so that the corresponding first conductors are required to obliquely and outwardly extend to comply with the first contacts, respectively, for soldering;

wherein the second passageways are formed in an expansion portion of the second wall, and a cavity is formed in the first wall aligned with the expansion portion in a transverse direction perpendicular to both said longitudinal direction and said front-to-back direction.

11. The assembly as claimed in claim 10, wherein the rear end of one of said second contacts is intentionally split into two spaced parts for respectively contacting two respective second conductors.

12. The assembly as claimed in claim 10, wherein the rear end of one of said first contacts connects two closely juxtaposed first conductors.

* * * * *